US006989811B2

(12) United States Patent
Enomoto et al.

(10) Patent No.: US 6,989,811 B2
(45) Date of Patent: Jan. 24, 2006

(54) LIQUID CRYSTAL DISPLAY DEVICE AND DRIVING CIRCUIT THEREOF

(75) Inventors: Hiromi Enomoto, Kawasaki (JP); Hongyong Zhang, Kawasaki (JP); Tsutomu Kai, Kawasaki (JP); Masanori Nakamura, Kawasaki (JP); Susumu Okazaki, Kawasaki (JP)

(73) Assignee: Fujitsu Display Technologies Corporation, Kawasaki (JP)

( * ) Notice: Subject to any disclaimer, the term of this patent is extended or adjusted under 35 U.S.C. 154(b) by 508 days.

(21) Appl. No.: 10/037,839

(22) Filed: Jan. 3, 2002

(65) Prior Publication Data

US 2002/0140664 A1 Oct. 3, 2002

(30) Foreign Application Priority Data

Mar. 30, 2001 (JP) ..... 2001-101175

(51) Int. Cl.
*G09G 3/36* (2006.01)

(52) U.S. Cl. ..... 345/98; 345/96; 345/92

(58) Field of Classification Search ..... 345/92, 345/97, 98, 96

See application file for complete search history.

(56) References Cited

U.S. PATENT DOCUMENTS

| | | | | | |
|---|---|---|---|---|---|
| 5,192,945 | A | * | 3/1993 | Kusada | 345/88 |
| 5,250,931 | A | * | 10/1993 | Misawa et al. | 345/206 |
| 5,576,730 | A | * | 11/1996 | Shimada et al. | 345/98 |
| 5,892,493 | A | * | 4/1999 | Enami et al. | 345/94 |
| 6,023,260 | A | * | 2/2000 | Higashi | 345/100 |
| 6,144,354 | A | * | 11/2000 | Koyama et al. | 345/98 |
| 6,529,181 | B2 | * | 3/2003 | Nakano et al. | 345/98 |
| 6,661,401 | B1 | * | 12/2003 | Sekine | 345/92 |

* cited by examiner

*Primary Examiner*—Albert Decady
*Assistant Examiner*—Fritz Alphonse
(74) *Attorney, Agent, or Firm*—Greer, Burns & Crain, Ltd.

(57) ABSTRACT

A driving circuit of a liquid crystal display device includes driver output lines connected to outputs of a data line driver, m pieces of block selection signal lines for sequentially selecting m pieces of blocks, and data lines for supplying data to a display area. A switch sequentially connects an ith driver output line to ith, i+2jth, . . . , and i+2jx(m−1)th data lines in response to signals on the m pieces of block selection signal lines when j is a positive integer smaller than m.

10 Claims, 8 Drawing Sheets

DATA LINE DRIVER
300
OUT1
OUT2
OUTn-1
OUTn
BL1
BL2
BL3
BL4
S1
S2
S3
S4
S5
S6
S7
S8
S4n-7
S4n-6
S4n-5
S4n-4
S4n-3
S4n-2
S4n-1
S4n
D1
D2
D3
D4
D5
D6
D7
D8
D4n-7
D4n-6
D4n-5
D4n-4
D4n-3
D4n-2
D4n-1
D4n

FIG. 5

| | BL1 | BL2 | BL3 | BL4 |
|---|---|---|---|---|
| OUT1 (RA) | R0001 | B0001 | G0002 | R0003 |
| OUT2 (GA) | G0001 | R0002 | B0002 | G0003 |
| OUT3 (BA) | B0003 | G0004 | R0005 | B0005 |
| OUT4 (RB) | R0004 | B0004 | G0005 | R0006 |
| OUT5 (GB) | G0006 | R0007 | B0007 | G0008 |
| OUT6 (BB) | B0006 | G0007 | R0008 | B0008 |
| OUT7 (RA) | R0009 | B0009 | G0010 | R0011 |
| OUT8 (GA) | G0009 | R0010 | B0010 | G0011 |
| OUT9 (BA) | B0011 | G0012 | R0013 | B0013 |
| OUT10 (RB) | R0012 | B0012 | G0013 | R0014 |
| OUT11 (GB) | G0014 | R0015 | B0015 | G0016 |
| OUT12 (BB) | B0014 | G0015 | R0016 | B0016 |
| OUT13 (RA) | R0017 | B0017 | G0018 | R0019 |
| OUT14 (GA) | G0017 | R0018 | B0018 | G0019 |
| OUT15 (BA) | B0019 | G0020 | R0021 | B0021 |
| OUT16 (RB) | R0020 | B0020 | G0021 | R0022 |
| OUT17 (GB) | G0022 | R0023 | B0023 | G0024 |
| OUT18 (BB) | B0022 | G0023 | R0024 | B0024 |
| ⋮ | | ⋮ | | |
| OUT384 (BB) | B0510 | G0511 | R0512 | B0512 |

FIG. 7A

| TAB1 | BL1 | BL2 | BL3 | BL4 |
|---|---|---|---|---|
| OUT1 (RA) | R0001 | B0001 | G0002 | R0003 |
| OUT2 (GA) | G0001 | R0002 | B0002 | G0003 |
| OUT3 (BA) | B0003 | G0004 | R0005 | B0005 |
| OUT4 (RB) | R0004 | B0004 | G0005 | R0006 |
| OUT5 (GB) | G0006 | R0007 | B0007 | G0008 |
| OUT6 (BB) | B0006 | G0007 | R0008 | B0008 |
| OUT7 (RA) | R0009 | B0009 | G0010 | R0011 |
| OUT8 (GA) | G0009 | R0010 | B0010 | G0011 |
| OUT9 (BA) | B0011 | G0012 | R0013 | B0013 |
| OUT10 (RB) | R0012 | B0012 | G0013 | R0014 |
| OUT11 (GB) | G0014 | R0015 | B0015 | G0016 |
| OUT12 (BB) | B0014 | G0015 | R0016 | B0016 |
| OUT13 (RA) | R0017 | B0017 | G0018 | R0019 |
| OUT14 (GA) | G0017 | R0018 | B0018 | G0019 |
| OUT15 (BA) | B0019 | G0020 | R0021 | B0021 |
| OUT16 (RB) | R0020 | B0020 | G0021 | R0022 |
| OUT17 (GB) | G0022 | R0023 | B0023 | G0024 |
| OUT18 (BB) | B0022 | G0023 | R0024 | B0024 |
| ⋮ | | | | |
| OUT384 (BB) | B0510 | G0511 | R0512 | B0512 |

FIG. 7B

| TAB2 | BL1 | BL2 | BL3 | BL4 |
|---|---|---|---|---|
| OUT1 (RA) | R0513 | B0513 | G0514 | R0515 |
| OUT2 (GA) | G0513 | R0514 | B0514 | G0515 |
| OUT3 (BA) | | | | |
| OUT4 (RB) | | | | |
| OUT5 (GB) | | | | |
| OUT6 (BB) | | | | |
| OUT7 (RA) | | | | |
| OUT8 (GA) | | | | |
| OUT9 (BA) | | | | |
| OUT10 (RB) | | | | |
| OUT11 (GB) | | | | |
| OUT12 (BB) | | | | |
| OUT13 (RA) | | | | |
| OUT14 (GA) | | | | |
| OUT15 (BA) | | | | |
| OUT16 (RB) | | | | |
| OUT17 (GB) | | | | |
| OUT18 (BB) | | | | |
| ⋮ | | | | |
| OUT384 (BB) | B1022 | G1023 | R1024 | B1024 |

FIG. 7C

| TAB3 | BL1 | BL2 | BL3 | BL4 |
|---|---|---|---|---|
| OUT1 (RA) | R1025 | B1025 | G1026 | R1027 |
| OUT2 (GA) | G1025 | R1026 | B1026 | G1027 |
| OUT3 (BA) | | | | |
| OUT4 (RB) | | | | |
| OUT5 (GB) | | | | |
| OUT6 (BB) | | | | |
| OUT7 (RA) | | | | |
| OUT8 (GA) | | | | |
| OUT9 (BA) | | | | |
| OUT10 (RB) | | | | |
| OUT11 (GB) | | | | |
| OUT12 (BB) | | | | |
| OUT13 (RA) | | | | |
| OUT14 (GA) | | | | |
| OUT15 (BA) | | | | |
| OUT16 (RB) | | | | |
| OUT17 (GB) | | | | |
| OUT18 (BB) | | | | |
| ⋮ | | | | |
| OUT384 (BB) | B1534 | G1535 | R1536 | B1536 |

FIG. 7D

| TAB4 | BL1 | BL2 | BL3 | BL4 |
|---|---|---|---|---|
| OUT1 (RA) | R1537 | B1537 | G1538 | R1539 |
| OUT2 (GA) | G1537 | R1538 | B1538 | G1539 |
| OUT3 (BA) | | | | |
| OUT4 (RB) | | | | |
| OUT5 (GB) | | | | |
| OUT6 (BB) | | | | |
| OUT7 (RA) | | | | |
| OUT8 (GA) | | | | |
| OUT9 (BA) | | | | |
| OUT10 (RB) | | | | |
| OUT11 (GB) | | | | |
| OUT12 (BB) | | | | |
| OUT13 (RA) | | | | |
| OUT14 (GA) | | | | |
| OUT15 (BA) | | | | |
| OUT16 (RB) | | | | |
| OUT17 (GB) | | | | |
| OUT18 (BB) | | | | |
| ⋮ | | | | |
| OUT384 (BB) | B2046 | G2047 | R2048 | B2048 |

LIQUID CRYSTAL DISPLAY DEVICE AND DRIVING CIRCUIT THEREOF

CROSS-REFERENCE TO RELATED APPLICATIONS

This application is based upon and claims priority of Japanese Patent Application No. 2001-101175, filed on Mar. 30, 2001, the contents being incorporated herein by reference.

BACKGROUND OF THE INVENTION

The present invention relates to a liquid crystal display device and a driving circuit thereof and, more particularly, to a driving circuit for supplying data outputted from a data line driver to a display area.

An active-matrix type liquid crystal display device, represented by a TFT (Thin Film Transistor) liquid crystal panel, is expected to become widespread as a display device for home use TVs and office automation devices. This is because the active-matrix type liquid crystal display device can be easily made to be thinner and lighter compared with a CRT, with no less high display quality than that of the CRT. Taking advantage of the thin and lightweight features, the device is demanded to be adopted not only to portable information devices such as a notebook personal computer but also to multimedia information devices of various kinds and an improvement in display quality is required for a polysilicon liquid crystal display (LCD) with a narrow frame.

FIG. 1 is a schematic view showing the structure of a liquid crystal display device. A signal source 101 such as a personal computer is connected to a connector 111 in a control circuit 110. The control circuit 110 includes a controller 112, connectors 113 and 114, a ROM 115, a power supply circuit 116, and a switch 117 in addition to the connector 111. The connector 113 in the control circuit 110 is connected to a connector 131 in a PCB (Printed Circuit Board) 130 via data lines (video signal lines) A121 and A122. The connector 114 in the control circuit 110 is connected to the PCB 130 via a control signal line (including a power source line) A123. The PCB 130 has a reference power source 132 in addition to the connector 131. Data on the data lines A121 and A122 is supplied to data line drivers TAB1, TAB2, TAB3, and TAB4 composed by TAB (tape automated bonding) via the connector 131. The data line drivers TAB1, TAB2, TAB3, and TAB4 supply data to a liquid crystal display panel 150.

The liquid crystal display panel 150 includes a scanning line driver 153, TFTs 151, and liquid crystal capacitors 152. The TFTs 151, which control pixels, are two-dimensionally provided. Outputs of the data line drivers TAB1, TAB2, TAB3, and TAB4 are connected to drains of the TFTs via data lines. Outputs of the scanning line driver 153 are connected to gates of the TFTs 151 via scanning lines. One end of each of the liquid capacitors 152 is connected to a source of each of the TFTs 151 and the other ends thereof are connected to a common reference terminal. The TFTs 151 supply data supplied from the data line drivers TAB1, TAB2, TAB3, and TAB4 to the liquid crystal capacitors 152 when the gates thereof are set to a high level. Thereby, the transmittance of the liquid crystal capacitors 152 varies to control the display.

FIG. 2 shows a driving circuit of a block sequential driving method of the prior art. A data line driver 200 corresponds to the data line driver TAB1, TAB2, TAB3, or TAB4 in FIG. 1. In FIG. 2, a part except for the data line driver 200 is a driving circuit and provided on the liquid crystal display panel 150 in FIG. 1.

The data line driver 200 is connected to n pieces of driver output lines OUT1 to OUTn. The n pieces of driver output lines OUT1 to OUTn are respectively connected to n pieces of data buses V1 to Vn.

Control terminals of switches S1 to Sn are connected with a block selection signal line BL1, input terminals thereof are connected with the data buses V1 to Vn respectively, and output terminals thereof are connected with data lines D1 to Dn respectively.

Control terminals of switches Sn+1 to S2*n* are connected with a block selection signal line BL2, input terminals thereof are connected with the data buses V1 to Vn respectively, and output terminals thereof are connected with data lines Dn+1 to D2*n* respectively.

Similarly, control terminals of switches S2*n*+1 to S3*n* are connected with a block selection signal line BL3 and control terminals of switches S3*n*+1 to S4*n* are connected with a block selection signal line BL4.

First of all, the block selection signal line BL1 is set to a high level and the block selection signal lines BL2 to BL4 are set to a low level. Then, the switches S1 to Sn are turned on to connect the input terminals and the output terminals. Accordingly, the driver output lines OUT1 to OUTn are connected to the data lines D1 to Dn respectively. Data outputted from the data line driver 200 is supplied to a display area (including the TFTs 151 and the liquid crystal capacitors 152 in FIG. 1) via the data lines D1 to Dn.

Secondly, the block selection signal line BL2 is set to the high level and the block selection signal lines BL1, BL3, and BL4 are set to the low level. Then, the switches Sn+1to S2*n* are turned on to connect the input terminals and the output terminals. Accordingly, the driver output lines OUT1 to OUTn are connected to the data lines Dn+1 to D2*n* respectively. Data outputted from the data line driver 200 is supplied to the display area via the data lines Dn+1 to D2*n*.

Thereafter, the operation in which the block selection signal lines BL1 to BL4 are sequentially set to the high level is repeatedly performed. Incidentally, the switches connected to the block selection signal lines BL1 to BL4 are not limited to the those which are turned on at the high level, and logically-reversed switches may be utilized.

In driving the polysilicon LCD of the block sequential driving method using the data line driver 200, since a data voltage from the data line driver 200 is first supplied to the data buses V1 to Vn and then transmitted to the data lines D1 to Dn leading to pixels, a majority intersections are required in a wiring region on the substrate, which causes reduced yield due to a short circuit between lines or the like and ghosts due to wiring cross-talk and loses the display quality.

SUMMARY OF THE INVENTION

It is an object of the present invention to provide a liquid crystal display device and a driving circuit thereof preventing the reduction in yield due to a short circuit between lines or the like and ghosts due to wiring cross-talk so as to realize high display quality by reducing wiring intersections on a substrate.

According to an aspect of the present invention, a driving circuit for a liquid crystal display device is provided, which comprises: driver output lines connected to outputs of a data line driver; m pieces of block selection signal lines for sequentially selecting m pieces of blocks; data lines for supplying data to a display area; and a switch sequentially connecting an ith driver output line to ith, i+2jth, . . . , and i+2j×(m−1)th data lines in response to signals on the m pieces of block selection signal lines when j is a positive integer smaller than m.

Since the data buses V1 to Vn in FIG. 2 can be eliminated, the number of the wiring intersections of the driver output lines and the data lines decreases. As a result, the yield in a process of fabricating a liquid crystal display panel improves and the ghosts due to the wiring cross-talk lessen so that a display of higher quality can be obtained.

BRIEF DESCRIPTION OF THE DRAWINGS

FIG. 5 is a table showing input/output of the driving circuit in FIG. 4;

FIGS. 7A to 7D are tables showing input/output of the driving circuits in FIG. 6.

DETAILED DESCRIPTION OF THE PREFERRED EMBODIMENTS

Figure 1:
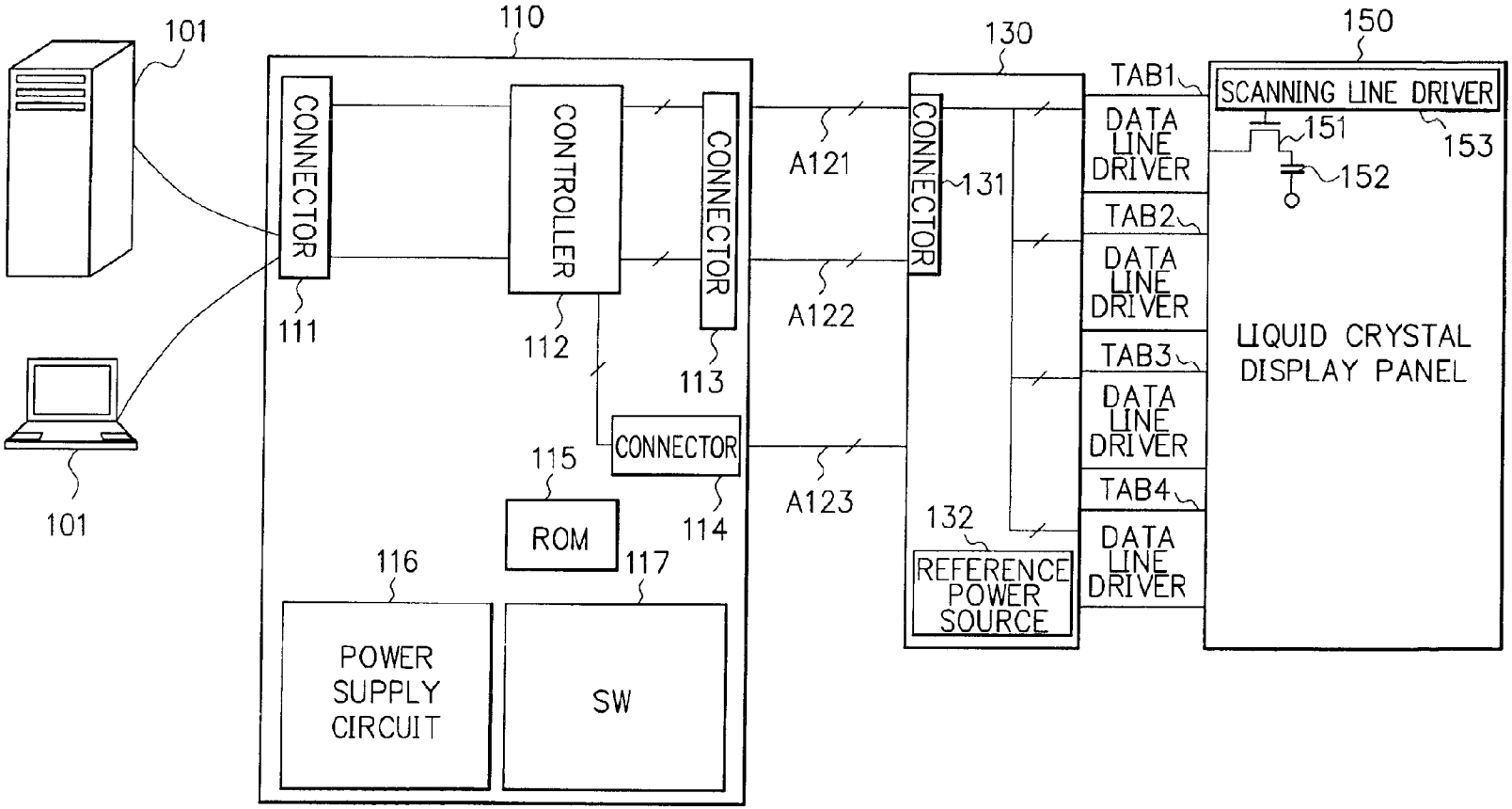
FIG. 1 is a schematic view of a structure of a liquid crystal display device.

The structure of a liquid crystal display device according to the first embodiment of the present invention is shown in FIG. 1. An explanation of this liquid crystal display device is the same as that described above.

A signal source 101 such as a personal computer is connected to a connector 111 in a control circuit 110. The control circuit 110 includes a controller 112, connectors 113 and 114, a ROM 115, a power supply circuit 116, and a switch 117 in addition to the connector 111. The connector 113 in the control circuit 110 is connected to a connector 131 in a PCB 130 via data lines (video signal lines) A121 and A122. The connector 114 in the control circuit 110 is connected to the PCB 130 via a control signal line (including a power source line) A123. The PCB 130 includes a reference power source 132 in addition to the connector 131. Data on the data lines A121 and A122 is supplied to data line drivers TAB1, TAB2, TAB3, and TAB4 composed by TAB (tape automated bonding). The data line drivers TAB1, TAB2, TAB3, and TAB4 supply data to a liquid crystal display panel 150.

The liquid crystal display panel 150 includes a scanning line driver 153, TFTs 151, and liquid crystal capacitors 152. The TFTs 151, which control pixels, are two-dimensionally provided. Outputs of the data line drivers TAB1, TAB2, TAB3, and TAB 4 are connected to drains of the TFTs via data lines. Outputs of the scanning line driver 153 are connected to gates of the TFTs 151 via scanning lines. One end of each of the liquid crystal capacitors 152 is connected to a source of each of the TFTs 151 and the other end thereof is connected to a common reference terminal. The TFTs 151 supply data which is supplied from the data line drivers TAB1, TAB2, TAB3, and TAB4 to the liquid crystal capacitors 152 when the gates are set to a high level. Thereby, the transmittance of the liquid crystal capacitors 152 varies so as to control the display.

This liquid crystal display device is an active-matrix type liquid crystal display device with high display quality among flat panel displays. The liquid crystal display device has a structure in which liquid crystal is sealed between a substrate on which electrodes run in a matrix and switching elements (such as TFTs) are connected to intersections thereof and a substrate on which electrodes run uniformly. Hereinafter the former substrate is referred to as a TFT substrate and the latter substrate is referred to as a common substrate. On the TFT substrate, the data lines (signal electrodes) and the scanning lines (scanning electrodes) intersect in the matrix and TFTs are connected to all of the intersections as switching elements. When TFTs in a line selected by a scanning line are turned on, a video signal voltage applied to a data line is written in each pixel electrode and the charge is held until the next time when the line is selected so that the information is maintained. Since a tilt of the liquid crystal is determined according to the maintained information, the transmittance of a light can be controlled, which enables gradation display and the like. Moreover, through use of color filters of red (R), green (G), and blue (B) for mixing the light, color display is realized.

A circuit for driving the LCD panel is structured by a scanning line driver driving each of the scanning lines, a data line driver driving each of the data lines, and a common voltage circuit connected to the common substrate. When the scanning line driver selects a scanning line, a video signal voltage from the data line driver is applied to each of the pixels which is connected to the scanning line. A polysilicon LCD has a structure in which a part or all of the circuits of the data line driver and the scanning line driver are mounted on the TFT substrate and is capable of driving the panel without equipping a driver IC so as to realize a narrow frame.

Generally, in the LCD panel, if a voltage of one polarity is continuously applied to one pixel, the life of the LCD is adversely affected and liquid crystal deteriorates. In order to prevent this, positive and negative driving voltages with respect to a reference voltage are applied at every frame or every horizontal period. This is referred to as an alternating current driving method.

When the liquid crystal display panel is the polysilicon panel, the control circuit is incorporated in a peripheral part on the TFT substrate. Further, the use of a block sequential driving method makes it possible to supply video signal data without a necessity of a driver IC which has the same number of outputs as that of the data lines in the pixel arrangement.

Since screen flicker occurs when performing the aforesaid alternating current driving method, a polarity of each data line needs to be reversed in order to suppress the flicker. For example, there is a method in which positive and negative voltages that are opposite to each other are applied to adjacent data lines so that voltages of opposite polarities are applied to adjacent pixels. This is referred to as a vertical line reversal driving method. The data line driver of a type enabling the vertical line reversal driving method, which outputs positive and negative voltages that are opposite to each other from adjacent output terminals thereof, is utilized so that a positive polar voltage and a negative polar voltage are outputted from odd-numbered and even-numbered output terminals respectively and supplied to the data lines.

Figure 3:
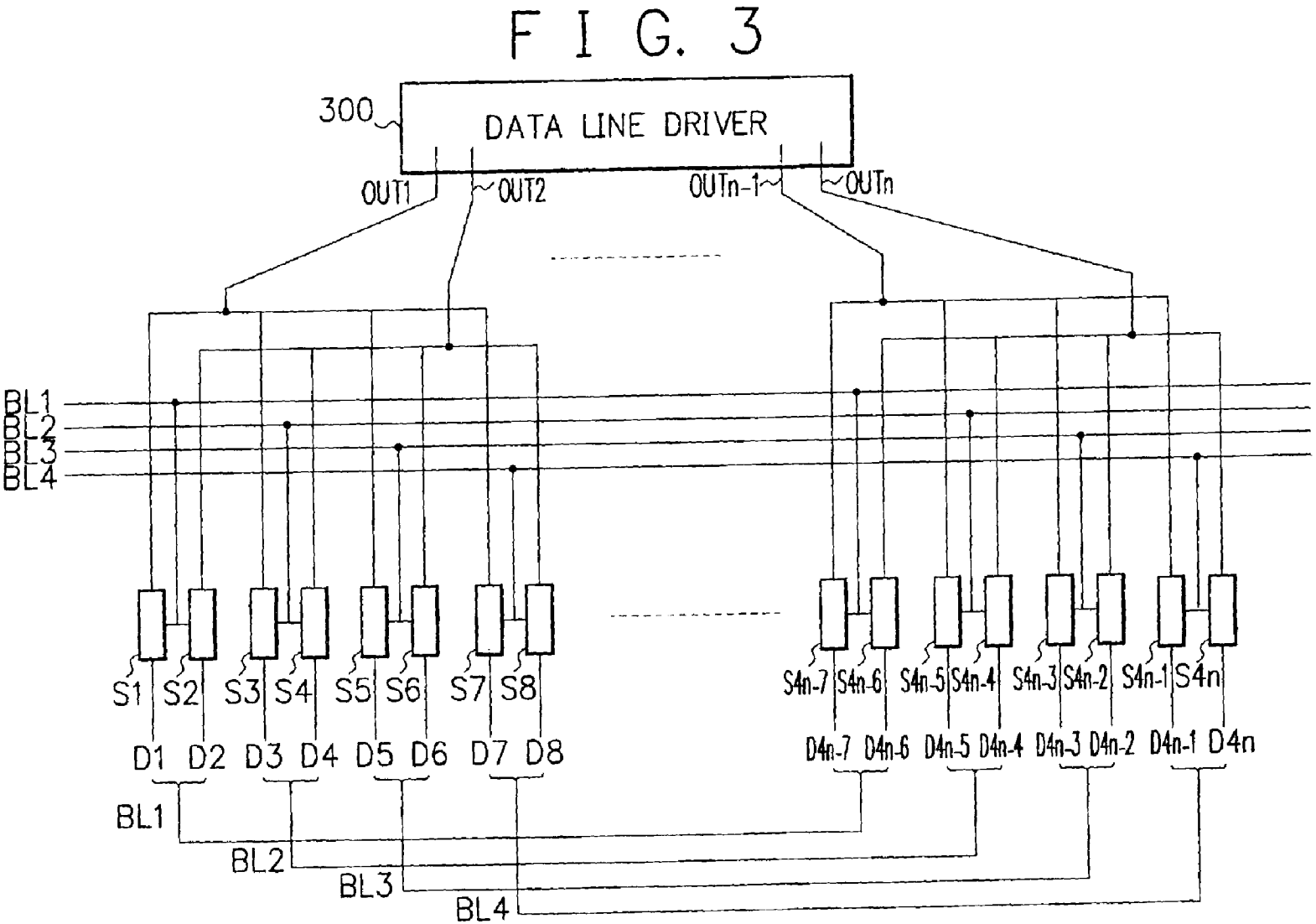
FIG. 3 is a structural view of a driving circuit of a block sequential driving method according to a first embodiment of the present invention.

FIG. 3 shows a driving circuit of the block sequential driving method according to this embodiment. A data line driver 300 corresponds to the data line driver TAB1, TAB2, TAB3, or TAB4 in FIG. 1. In FIG. 3, a part except for the data line driver 300 is a driving circuit and provided on the liquid crystal display panel 150 in FIG. 1.

The data line driver 300 is connected to n pieces of driver output lines OUT1 to OUTn. The first driver output line OUT1 is connected to input terminals of switches S1, S3, S5, and S7. The second driver output line OUT2 is connected to input terminals of switches S2, S4, S6, and S8. Output terminals of the switches S1 to S8 are connected to data lines D1 to D8 respectively.

Control terminals of the switches S1 and S2 are connected to a block selection signal line BL1. Control terminals of the switches S3 and S4 are connected to a block selection signal line BL2. Control terminals of the switches S5 and S6 are connected to a block selection signal line BL3. Control terminals of the switches S7 and S8 are connected to a block selection signal line BL4.

Similarly, the n−1th driver output line OUTn−1is connected to input terminals of switches S4*n*−7, S4*n*−5, S4*n*−3, and S4*n*−1. The nth driver output line OUTn is connected to input terminals of switches S4*n*−6, S4*n*−4, S4*n*−2, and S4n. Output terminals of the switches S4*n*−7 to S4n are connected to data lines D4*n*−7 to D4n respectively.

Control terminals of the switches S4*n*−7 and S4*n*−6 are connected to the block selection signal line BL1. Control terminals of the switches S4*n*−5 and S4*n*−4 are connected to the block selection signal line BL2. Control terminals of the switches S4*n*−3 and S4*n*−2 are connected to the block selection signal line BL3. Control terminals of the switches S4*n*−1 and S4*n* are connected to the block selection signal line BL4. Other driver output lines OUT3 to OUTn−2 are connected in the same way.

First, the block selection signal line BL1 is set to a high level and the block selection signal lines BL2 to BL4 are set to a low level. Then, the switches S1, S2, S4*n*−7, S4*n*−6, and so on are turned on to connect the input terminals and the output terminals. Accordingly, the driver output lines OUT1, OUT2, OUTn−1, OUTn, and so on are connected to the Rap data lines D1, D2, D4*n*−7, D4*n*−6, and so on respectively. Data outputted from the data line driver 300 is supplied to a display area (including the TFTs 151 and the liquid crystal capacitors 152 in FIG. 1) via the data lines D1, D2, D4*n*−7, D4*n*−6, and so on.

Secondly, the block selection signal line BL2 is set to the high level and the block selection signal lines BL1, BL3, and BL4 are set to the low level. Then, the switches S3, S4, S4*n*−5, S4*n*−4, and so on are turned on to connect the input terminals and the output terminals. Accordingly, the driver output lines OUT1, OUT2, OUTn−1, OUTn, and so on are connected to the data lines D3, D4, D4*n*−5, D4*n*−4, and so on respectively. Data outputted from the data line driver 300 is supplied to the display area via the data lines D3, D4, D4*n*−5, D4*n*−4, and so on.

Thirdly, the block selection signal line BL3 is set to the high level and the block selection signal lines BL1, BL2, and BL4 are set to the low level. Then, the switches S5, S6, S4*n*−3, S4*n*−2, and so on are turned on to connect the input terminals and the output terminals. Accordingly, the driver output lines OUT1, OUT2, OUTn−1, OUTn, and so on are connected to the data lines D5, D6, D4*n*−3, D4*n*−2, and so on respectively. Data outputted from the data line driver 300 is supplied to the display area via the data lines D5, D6, D4*n*−3, D4*n*−2, and so on.

Finally, the block selection signal line BL4 is set to the high level and the block selection signal lines BL1 to BL3 are set to the low level. Then, the switches S7, S8, S4*n*−1, S4*n*, and so on are turned on to connect the input terminals and the output terminals. Accordingly, the driver output lines OUT1, OUT2, OUTn−1, OUTn, and so on are connected to the data lines D7, D8, D4*n*−1, D4*n*, and so on respectively. Data outputted from the data line driver 300 is supplied to the display area via the data lines D7, D8, D4*n*−1, D4*n*, and so on.

Thereafter, the operation in which the block selection signal lines BL1 to BL4 are sequentially set to the high level is repeatedly performed in the same way. Incidentally, the switches connected to the block selection signal lines BL1 to BL4 are not limited to the those which are turned on at the high level, and logically-reversed switches may be utilized depending on the circuit structure.

In this embodiment, in the polysilicon LCD of the block sequential driving method using the general data line driver 300, the positive and negative voltages that are opposite to each other with respect to the reference voltage are applied to the adjacent data lines to enable the vertical line reversal driving method. Moreover, the block sequential driving method is made to have a block structure in which blocks are distributed to all over panel pixel lines in a display area so as to eliminate the data buses V1 to Vn in FIG. 2 and the intersections of wiring from the output terminals of the data line driver 300 and prevent yield from decreasing due to a short circuit between lines and so on. In addition, the realization of the polarity reversal driving of the adjacent data lines reduces the flicker, which makes it possible to provide the driving circuit for the polysilicon LCD with improved display quality.

This driving circuit for the liquid crystal display device is a driving circuit structured to drive an output from the data line driver 300 by an m block sequential driving method so that positive and negative data voltages that are opposite to each other are applied to the data lines of adjacent pixels. The output terminals of the data line driver 300 are structured to output voltages of positive and negative polarities that are opposite to each other to odd-numbered lines and even-numbered lines and, in the m block sequential driving method, one of the driver output lines drives the data lines. From the outputs of the data line driver 300, data of different polarities are outputted alternately in a manner in which an odd-numbered pin outputs a positive polar voltage and an even-numbered pin outputs a negative polar voltage and vice versa, and when j is a positive integer smaller than m, the ith output of the data line driver sequentially drives the data lines of the ith, i+2jth, . . . , and i+2j×(m−1)th m blocks, thereby eliminating the intersections of the wiring from the outputs of the data line driver 300 to the data lines, supplying voltages so that data polarities of the adjacent pixel lines in the liquid crystal display panel become positive and negative that are opposite to each other, and reversing the polarities so as to realize the vertical line reversal driving. Accordingly, in the pixel lines, voltages applied to the adjacent pixels become positive and negative voltages that are opposite to each other. As thus structured, a liquid crystal display device with the excellent display quality and the reduced flicker can be provided.

In FIG. 3, an example of j=1 particularly using the m (=4) block sequential driving method is shown. The outputs of the data line driver 300 are connected to the data lines in the liquid crystal display panel, and the arrangement is structured in which the same number of the data lines as the number (m=4) of divided blocks are driven by one of the driver output lines. The adjacent outputs of the data line driver 300 output positive and negative voltages that are opposite to each other.

Figure 2:
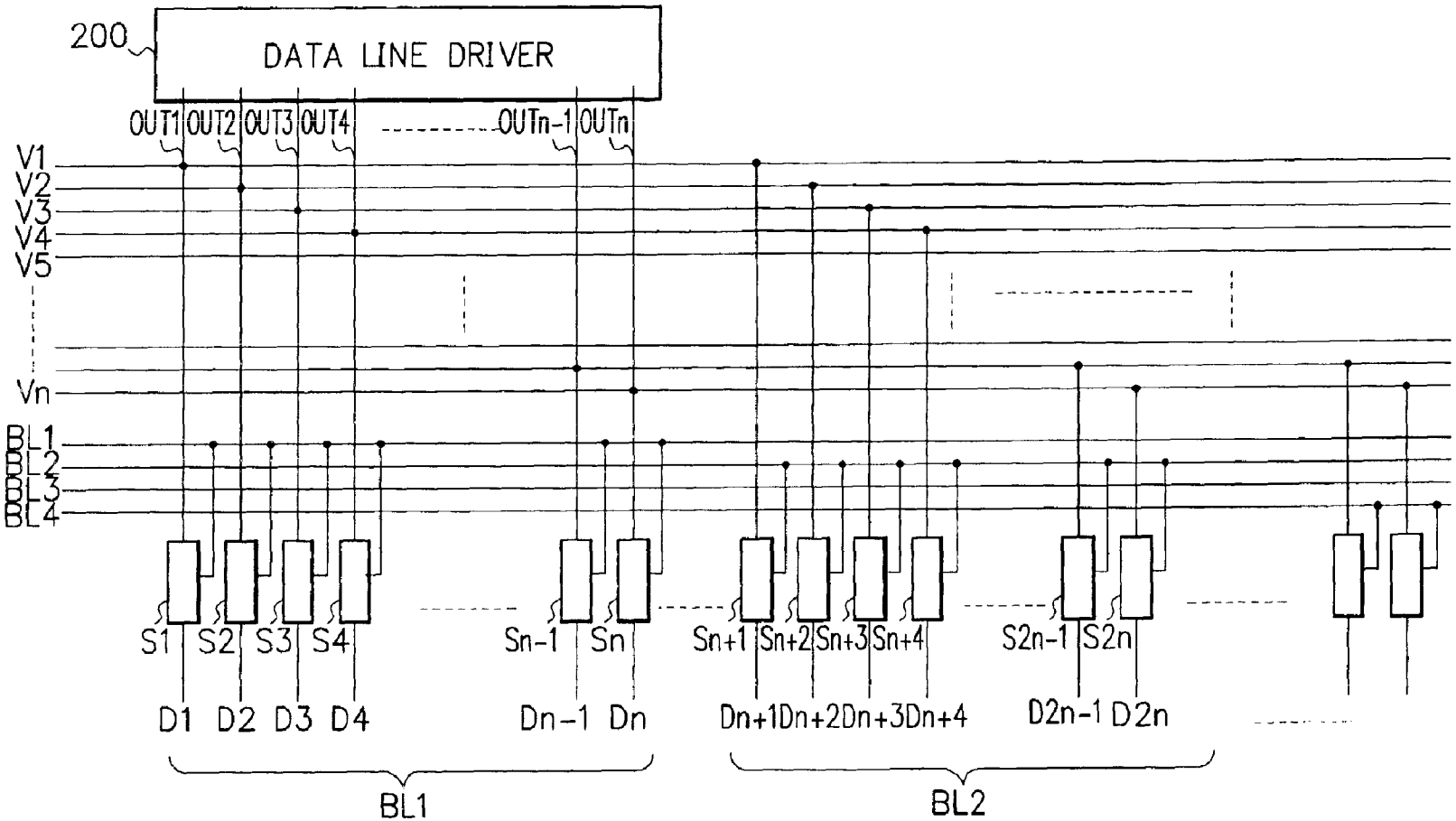
FIG. 2 PRIOR ART
FIG. 2 is a structural view of an arrangement of a block sequential driving method according to the prior art.

On this occasion, the data lines have an arrangement structure in which odd-numbered output signals and even-numbered output signals are alternately applied to the pixel lines so that the positive and negative voltages that are opposite to each other are supplied thereto. Although a majority wiring intersections for supplying data to each of the data lines exist in the prior block sequential driving method as shown in FIG. 2, the wiring intersections can be reduced if the blocks are distributed to all over the panel display area as shown in FIG. 3. Further, the block selection signal lines BL1 to BL4, each of which supplies data to a set of two analog switches connected to the adjacent data lines, can be communized and the wiring can be simplified.

A data voltage supplied in such an arrangement is supplied to the data lines at respective timing in response to signals on the block selection signal lines BL1 to BL4, held therein, and applied to each of the pixels in response to control signals from the scanning line driver. The wiring on the panel substrate also adopts the arrangement structure as shown in FIG. 3, which realizes the vertical line reversal driving method in which voltage values of opposite polarities are constantly applied to adjacent pixels, and the excellent display quality with reduced flicker can be obtained. Furthermore, the reduction in the wiring intersections improves the yield in a panel fabrication process and lessens the ghosts due to the wiring cross-talk so that the excellent display can be obtained.

Figure 4:
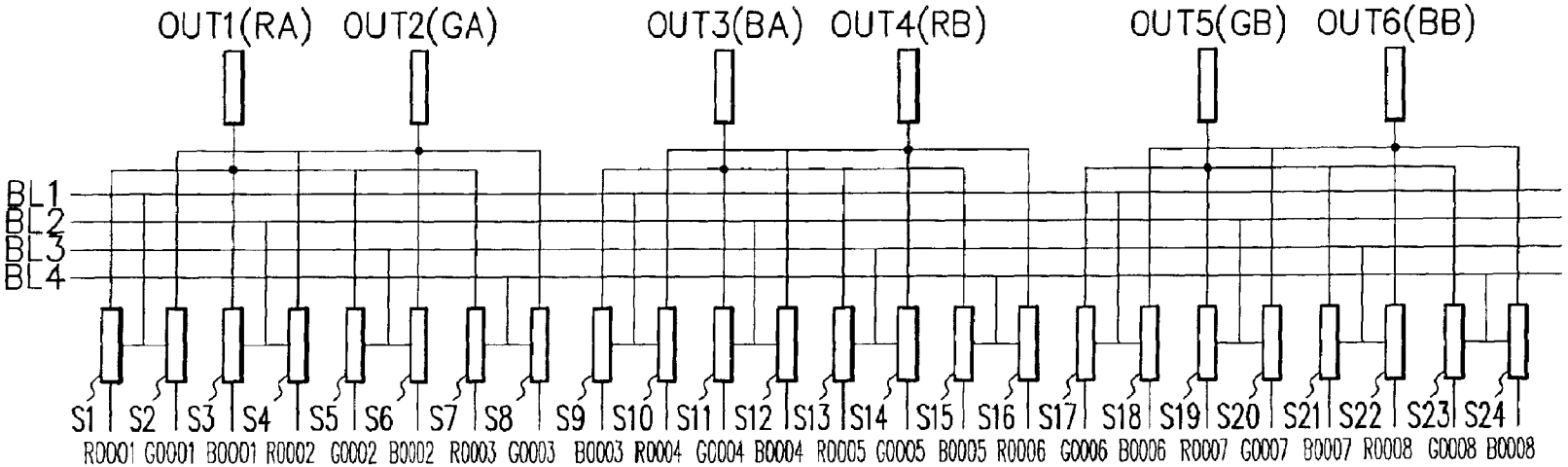
FIG. 4 is a structural view of a driving circuit according to a second embodiment of the present invention.

FIG. 4 shows a driving circuit according to the second embodiment of the present invention and FIG. 5 shows an input/output table of the driving circuit in FIG. 4.

A first driver output line OUT1 (RA) is a line for red (R) data. A second driver output line OUT2 (GA) is a line for green (G) data. A third driver output line OUT3 (BA) is a line for blue (B) data.

A fourth driver output line OUT4 (RB) is a line for red data. A fifth driver output line OUT5 (GB) is a line for green data. A sixth driver output line OUT6 (BB) is a line for blue data. Other driver output lines OUT7 to OUTn are lines for sequentially inputting data of the three colors of R, G, and B in parallel in order.

The driver output lines OUT1 to OUTn, the block selection signal lines BL1 to BL4, and the switches S1 to S4*n* are connected in the same way as in FIG. 3.

First, when the block selection signal line BL1 is set to a high level, the driver output lines OUT1 to OUT6 and so on supply data R0001, G0001, B0003, R0004, G0006, B0006, and so on to a display area via the switches S1, S2, S9, S10, S17, S18, and so on respectively.

Secondly, when the block selection signal line BL2 is set to the high level, the driver output lines OUT1 to OUT6 and so on supply data B0001, R0002, G0004, B0004, R0007, G0007, and so on to the display area via the switches S3, S4, S11, S12, S19, S20, and so on respectively.

Thirdly, when the block selection signal line BL3 is set to the high level, the driver output lines OUT1 to OUT6 and so on supply data G0002, B0002, R0005, G0005, B0007, R0008, and so on to the display area via the switches S5, S6, S13, S14, S21, S22, and so on respectively.

Finally, when the block selection signal line BL4 is set to the high level, the driver output lines OUT1 to OUT6 and so on supply data R0003, G0003, B0005, R0006, G0008, B0008, and so on to the display area via the switches S7, S8, S15, S16, S23, S24, and so on respectively.

This embodiment shows a case in which the color data of R, G, and B are included. As for the outputs of the data line driver, data of three colors of RGB is sequentially outputted in parallel in such order starting from the first output as R0001, G0001, B0001, R0002, G0002, B0002, . . . , and further, voltages of positive and negative polarities that are opposite to each other are separated into odd-numbered outputs and even-numbered outputs and outputted. In addition, data to be inputted is divided into the three types of R, G, and B. When the number m of the divided blocks is not a multiple of the three types, data swapping needs to be performed as in this embodiment. If data is inputted on a timing structure shown in FIG. 5, data of each of the colors R, G, and B can be supplied while the adjacent data lines have the positive and negative polarities that are opposite to each other, which makes it possible to obtain the excellent color display with reduced flicker.

Figure 6:
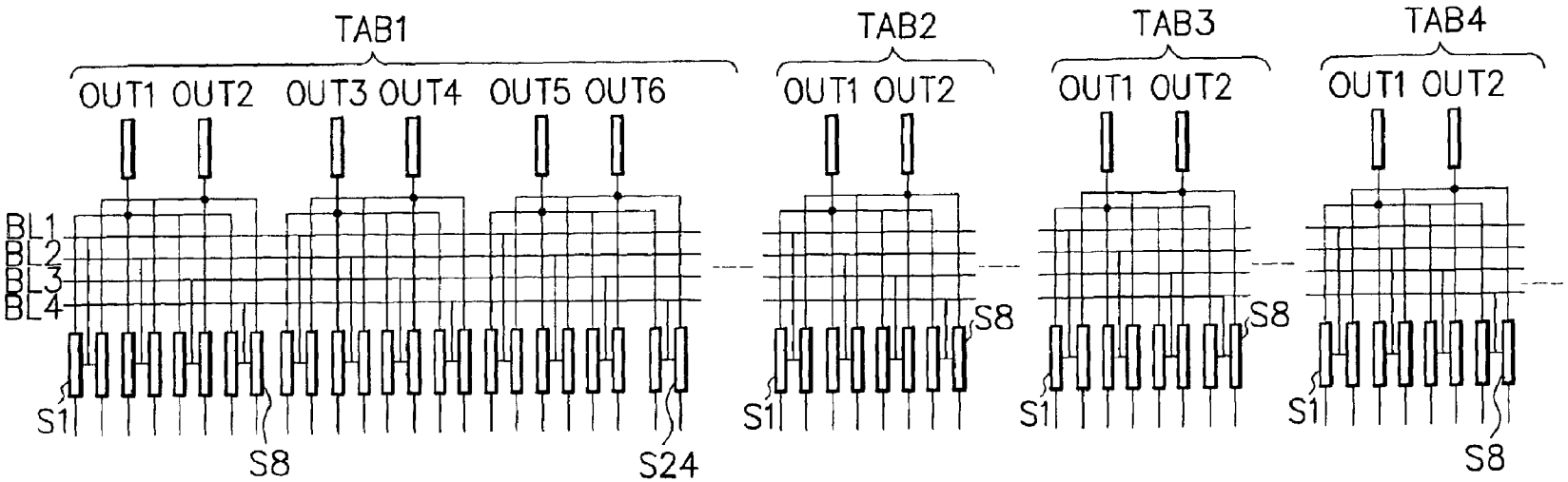
FIG. 6 is a structural view of driving circuits according to a third embodiment of the present invention.

FIG. 6 shows driving circuits according to the third embodiment of the present invention. In the first embodiment (FIG. 3), the driving circuit connected only to the data line driver TAB1 in FIG. 1 is shown. In the third embodiment, the driving circuits connected to the four data line drivers TAB1 to TAB4 in FIG. 1 are shown. The driving circuits connected to the data line drivers TAB2 to TAB4 are the same as the driving circuit connected to the data line driver TAB1.

This embodiment can realize the driving of a super-high resolution monochrome liquid crystal display panel by using the data line drivers in the block sequential driving method with a structure in which the blocks are distributed to all over the display area as explained in the first embodiment. The adoption of the aforesaid block sequential driving method reduces the intersections of the wiring from output portions of the data line drivers, which improves the yield and lessens the ghosts due to the wiring cross-talk so that the excellent display can be obtained. Moreover, this embodiment also shows an example in which the excellent display with reduced flicker can be obtained even in the driving of the super-high resolution panel with the increased number of pixel lines provided therein by realizing the supply of voltages of positive and negative polarities that are opposite to each other to adjacent pixel lines.

Furthermore, a super-high resolution color liquid crystal display panel can be realized using the input data structure of the data of each of the colors R, G, and B of the second embodiment (FIG. 4). Also in this case, in which the circuit is structured to drive the super-high resolution panel with the increased number of pixel lines provided therein using the data line drivers, data to be inputted to each of the data line drivers is structured and inputted as shown in FIG. 7A to 7D, which reduces the flicker and realizes the improvement in the color display quality.

FIGS. 7A to 7D show input/output tables of the driving circuits in FIG. 6. FIG. 7A shows the input/output of the driving circuit connected to the data line driver TAB1 and is the same as the input/output table in FIG. 5.

FIG. 7B shows the input/output of the driving circuit connected to the data line driver TAB2. Firstly, when the block selection signal line BL1 is set to a high level, the driver output lines OUT1, OUT2, and so on supply data R0513, G0513, and so on to a display area via the switches S1, S2, and so on respectively. Secondly, when the block selection signal line BL2 is set to the high level, the driver output lines OUT1, OUT2, and so on supply data B0513, R0514, and so on to the display area via the switches S3, S4, and so on respectively. Thirdly, when the block selection signal line BL3 is set to the high level, the driver output lines OUT1, OUT2, and so on supply data G0514, B0514, and so on to the display area via the switches S5, S6, and so on respectively. Finally, when the block selection signal line BL4 is set to the high level, the driver output lines OUT1, OUT2, and so on supply data R0515, G0515, and so on to the display area via the switches S7, S8, and so on respectively.

FIG. 7C shows the input/output of the driving circuit connected to the data line driver TAB3. Firstly, when the block selection signal line BL1 is set to the high level, the driver output lines OUT1, OUT2, and so on supply data R1025, G1025, and so on to the display area via the switches S1, S2, and so on respectively. Secondly, when the block selection signal line BL2 is set to the high level, the driver output lines OUT1, OUT2, and so on supply data B1025, R1026, and so on to the display area via the switches S3, S4, and so on respectively. Thirdly, when the block selection signal line BL3 is set to the high level, the driver output lines OUT1, OUT2, and so on supply data G1026, B1026, and so on to the display area via the switches S5, S6, and so on respectively. Finally, when the block selection signal line BL4 is set to the high level, the driver output lines OUT1, OUT2, and so on supply data R1027, G1027, and so on to the display area via the switches S7, S8, and so on respectively.

FIG. 7D shows the input/output of the driving circuit connected to the data line driver TAB4. Firstly, when the block selection signal line BL1 is set to the high level, the driver output lines OUT1, OUT2, and so on supply data R1537, G1537, and so on to the display area via the switches S1, S2, and so on respectively. Secondly, when the block selection signal line BL2 is set to the high level, the driver output lines OUT1, OUT2, and so on supply data B1537, R1538, and so on to the display area via the switches S3, S4, and so on respectively. Thirdly, when the block selection signal line BL3 is set to the high level, the driver output lines OUT1, OUT2, and so on supply data G1538, B1538, and so on to the display area via the switches S5, S6, and so on respectively. Finally, when the block selection signal line BL4 is set to the high level, the driver output lines OUT1, OUT2, and so on supply data R1539, G1539, and so on to the display area via the switches S7, S8, and so on respectively.

As described above, in the driving circuit of the block sequential driving method in which voltages of positive and negative polarities that are opposite to each other are supplied from one output of the data line driver to the data lines, the block sequential driving method with a structure in which the blocks are distributed to all over the display area is adopted in place of the method with a structure in which display pixel parts are divided into blocks from one end thereof as in the prior art, which reduces the intersections of the wiring from the outputs of the data line driver to the data lines. As a result, the yield in a panel fabrication process is improved and the ghosts due to the wiring cross-talk is lessened. Since the blocks are arranged in a distributed manner, unevenness among the blocks is also eased to realize the excellent display quality. Additionally, the positive and negative voltages that are opposite to each other are applied to the adjacent data lines so that a liquid crystal display device of the excellent display with reduced flicker can be obtained. Moreover, the use of the data line drivers also allows a super-high resolution panel to display with the high display quality.

Figure 8:
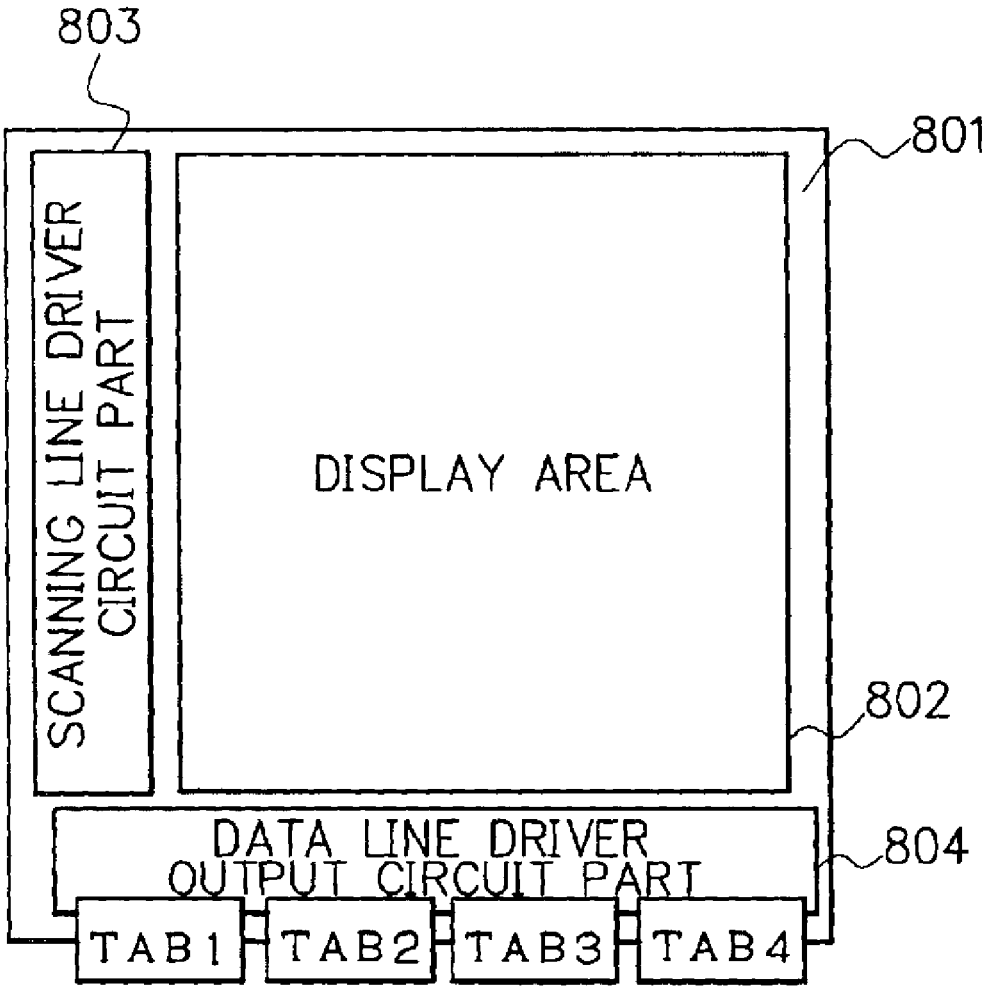
FIG. 8 is a schematic view of a liquid crystal display device using a driving circuit according to embodiments of the present invention.

FIG. 8 shows a schematic view of a liquid crystal display device in which the driving circuits according to the first to third embodiments of the present invention are provided in a data line driver output circuit part thereof. The whole structure of the liquid crystal display device is the same as that in FIG. 1. Liquid crystal is filled between a TFT substrate 801 and a common substrate 802, and a part where the TFT substrate 801 and the common substrate 802 overlap serves as a display area (display part). The common substrate 802 has a common electrode. On the TFT substrate 801, a scanning line driver circuit part 803 and a data line driver output circuit part 804 are formed together with the TFTs in the display area. The data line driver output circuit part 804 is connected with the data line drivers TAB1 to TAB4. Data is supplied to the data lines in the same way as in the first to third embodiments and a liquid crystal display device with the excellent display quality can be realized.

As explained above, in the driving circuit of the block sequential driving method using the data line driver which supplies data from one of its output terminals to the data lines, the first to third embodiments realize the excellent display quality by supplying data voltages of positive and negative polarities that are opposite to each other to the adjacent data lines so as to reduce the flicker. Further, the block sequential driving method with a structure in which the blocks are distributed to all over the display area is adopted to bring about effects such as the elimination of the ghosts due to the wiring cross-talk, the reduction in the unevenness among the blocks, and the like.

It should be noted that any of the above-described embodiments is just a concrete example for carrying out the present invention, and therefore the technical range of the present invention is not intended to be interpreted in a narrow sense by them. In other words, the present invention can be realized in various forms without departing from its technical idea or its primary characteristics.

As has been described, the number of the wiring intersections of the driver output lines and the data lines decreases, which improves the yield in the process of fabricating a liquid crystal display panel and lessens the ghosts due to the wiring cross-talk so that the high quality display can be obtained.

What is claimed is:

1. A driving circuit for a liquid crystal display comprising:

driver output lines connected to an output of a data line driver;

m pieces of block selection signal lines for sequentially selecting m pieces of blocks;

data lines for supplying data to a display area; and a switch sequentially connecting an ith of said driver output lines to ith, i+2jth, . . . , and i+2jx(m−1)th of said data lines in response to signals on said m pieces of block selection signal lines when j is a positive integer smaller than m;

wherein positive and negative voltages that are opposite to each other with respect to a reference voltage are applied to odd-numbered data lines and even-numbered data lines, and wherein positive and negative polarities of each of said data lines are alternately reversed.

2. The driving circuit for a liquid crystal display device according to claim 1, wherein the j is 1, and wherein, when one piece of said block selection signal lines is selected, said switch conducts output to two pieces of said data lines adjacent to each other corresponding to the one piece of said block selection signal lines.

3. The driving circuit for a liquid crystal display device according to claim 2, wherein, when one piece of said block selection signal lines is selected, said switch connects two pieces of said driver output lines adjacent to each other corresponding to the one piece of said block selection signal lines to two pieces of said data lines adjacent to each other respectively.

4. The driving circuit for a liquid crystal display device according to claim 2, wherein data of three colors of red, green, and blue is sequentially inputted to said driver output lines in parallel in order, and wherein data of three colors of red, green, and blue is sequentially outputted to said data lines in parallel in order.

5. The driving circuit for a liquid crystal display device according to claim 4, wherein said driver output lines are connected to the outputs of the data line driver.

6. The driving circuit for a liquid crystal display device according to claim 5, wherein, when one piece of said block selection signal lines is selected, said switch connects two pieces of said driver output lines adjacent to each other corresponding to the one piece of said block selection signal lines to two of said data lines adjacent to each other respectively.

7. The driving circuit for a liquid crystal display device according to claim 1, wherein data of three colors of red, green, and blue is sequentially inputted to said driver output lines in parallel in order, and wherein data of three colors of red, green, and blue is sequentially outputted to said data lines in parallel in order.

8. The driving circuit for a liquid crystal display device according to claim 7, wherein said driver output lines are connected to the outputs of the data line driver.

9. The driving circuit for a liquid crystal display device according to claim 1, wherein said driver output lines are connected to the outputs of the data line driver.

10. The liquid crystal display device having the driving circuit claimed in claim 1 and a display part.

* * * * *